US005433381A

United States Patent [19]

Stenzel et al.

[11] Patent Number: 5,433,381

[45] Date of Patent: Jul. 18, 1995

[54] DIRECT DRIVE SWIVEL

[75] Inventors: Andre Stenzel, Houston; Kyle M. Hawkins, Pasadena, both of Tex.

[73] Assignee: CRC-Evans Rehabilitation Systems, Inc., Houston, Tex.

[21] Appl. No.: 263,530

[22] Filed: Jun. 22, 1994

[51] Int. Cl.[6] ..... B05B 3/12

[52] U.S. Cl. ..... 239/263; 239/263.3

[58] Field of Search ..... 239/225.1, 263, 263.1, 239/263.3, 264; 285/272; 415/202

[56] References Cited

U.S. PATENT DOCUMENTS

| | | | |
|---|---|---|---|
| 1,876,607 | 9/1932 | Butterworth | 239/263 |
| 2,378,329 | 6/1945 | Rotter et al. . | |
| 2,414,997 | 1/1947 | Atkins . | |
| 2,719,529 | 10/1955 | Wells | 239/263.1 |
| 2,797,964 | 7/1957 | Alexander | 239/263 |
| 3,129,960 | 4/1964 | Schrodt . | |
| 3,517,952 | 6/1970 | McCracken . | |
| 3,877,732 | 4/1975 | Mohaupt . | |
| 3,967,842 | 7/1976 | Kendrick . | |
| 4,088,350 | 5/1978 | Lee, II . | |
| 4,221,408 | 9/1980 | Lochte et al. . | |
| 4,462,617 | 7/1984 | Green . | |
| 4,561,681 | 12/1985 | Lebsock . | |

FOREIGN PATENT DOCUMENTS 2383714 11/1978 France ..... 239/263

OTHER PUBLICATIONS

Hammelmann Corp. Drawing Number 00.95849.0001-33, Aug., 1992.

Hammelmann Corp. Drawing Number 09.00530.4547-33, Sep., 1993.

Stoneage Inc. Brochure, May 12, 1989.

*Primary Examiner*—Karen B. Merritt

*Attorney, Agent, or Firm*—Richards, Medlock & Andrews

[57] ABSTRACT

A direct drive motor and swivel assembly is provided. The assembly comprises a motor with a modified motor shaft extending through the motor. The motor shaft has a longitudinal passageway extending therethrough and a first end which is disposed outside of the motor and a second end opposite thereto. The swivel shaft of a swivel is axially aligned with the first end of the motor shaft and coupled thereto at a point outside of the motor such that the motor shaft passageway and swivel shaft passageway are in communication. The second end of the motor shaft may be connected to nozzles such that fluid flowing through the swivel housing into the swivel shaft and motor shaft will exit the second end of the motor shaft and flow through nozzles.

11 Claims, 2 Drawing Sheets

DIRECT DRIVE SWIVEL

TECHNICAL FIELD OF THE INVENTION

The present invention relates to a motor and swivel assembly, and more particularly to such an assembly where the swivel shaft is directly coupled to and driven by a modified motor shaft.

BACKGROUND OF THE INVENTION

High pressure water swivels are used in a variety of applications. For example, water swivels can be mounted on a machine that travels along a pipeline, and the water emitted from the rotating nozzles of the water swivels cleans the exterior of the pipeline. Water swivels are also used for concrete hydro-demolition, concrete scarification, runway cleaning, et cetera. A typical water swivel is indirectly driven by a motor with some type of sprocket arrangement or a gear box. Chain drive sprocket boxes are susceptible to premature failure in the harsh environments. Failure can occur due to a variety of reasons, including poor chain alignment, sprocket wear, chain wear, lubricant leaking out of the drive box or water and debris getting into the drive box and contaminating the lubricant. Other types of indirect drives, such as cogged belts, are also susceptible to the same problems. While there are heavy duty gear boxes available which could avoid these problems, such heavy duty gear boxes are not preferred because they are bulky, heavy, and expensive.

Therefore, a need exists for a swivel assembly wherein the swivel is rotated without the need for any indirect drive mechanisms which could be prone to the failures discussed above. A further need exists for such an assembly where the swivel and motor can be readily coupled and uncoupled in the field for faster and easier installation, as well as for simple replacement of a swivel should it need to be replaced.

SUMMARY OF THE INVENTION

The present invention provides a direct drive motor and swivel assembly comprising a motor with a modified motor shaft that extends through the motor having a first end and a second end opposite thereto. At least the first end of the motor shaft is disposed outside of the motor. The motor shaft defines a motor shaft passageway extending therethrough from the first end to the second end.

The assembly further comprises a swivel which comprises a housing that rotatably receives a swivel shaft that has a supply end and a shaft end opposite thereto. The swivel shaft defines a swivel passageway extending therethrough from the supply end to the shaft end. The swivel shaft is axially aligned with the motor shaft and the shaft end of the swivel shaft is connected to the first end of the motor shaft outside of the motor. The swivel passageway is in communication with the motor shaft passageway, and the swivel shaft rotates with the motor shaft. The swivel housing rotatably receives the supply end of the swivel shaft such that the swivel shaft rotates independently of the swivel housing. The swivel housing defines a supply passageway in communication with the swivel passageway.

The assembly of the present invention provides a direct drive motor and swivel assembly with a compact arrangement that is easily assembled and disassembled. The direct driving of the swivel by the motor shaft eliminates indirect drive mechanisms such as chain drives and gear boxes that are prone to failure. Furthermore, should the swivel fail, it can be readily uncoupled from the exposed motor shaft and replaced by a new swivel.

DETAILED DESCRIPTION OF THE PREFERRED EMBODIMENT

Figure 1:
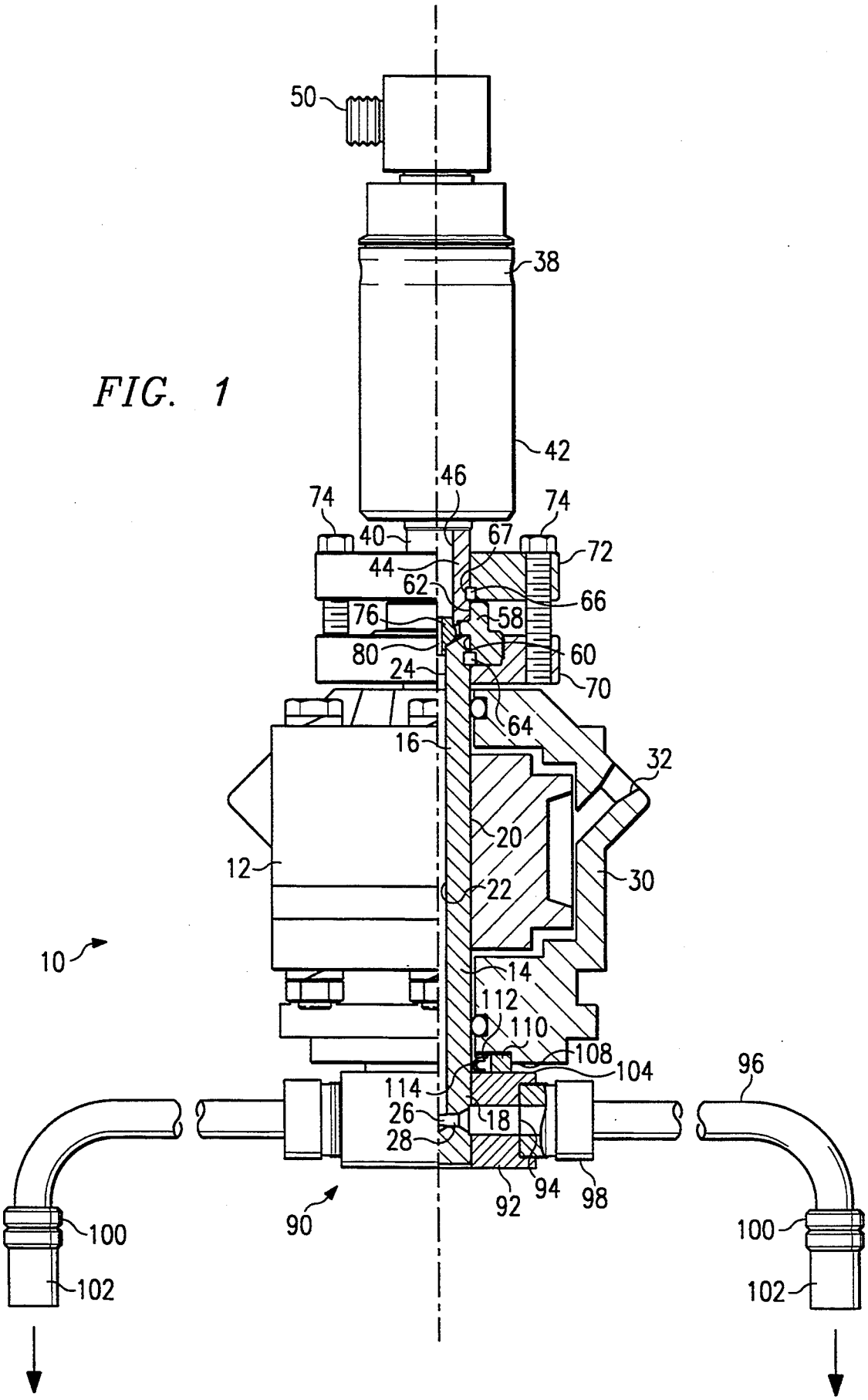
FIG. 1 is a partial quarter section of a direct drive motor shaft and swivel assembly of the preferred embodiment of the present invention.

With reference to FIG. 1, the preferred embodiment of the direct drive motor and swivel assembly of the present invention is shown. The assembly 10 comprises motor 12 which has modified motor shaft 14 that is rotated by motor 12. Motor shaft 14 is generally cylindrical and has first end 16 disposed outside of motor 12 and second end 18 opposite first end 16. Second end 18 may alternatively not extend outside of motor 12. Motor shaft 14 has generally cylindrical outside surface 20. Motor shaft 14 also defines motor shaft passageway 22 which extends generally longitudinally through motor shaft 14 between first end 16 and second end 18. In the preferred embodiment, motor shaft passageway 22 has first end 24 which exits first end 16 of motor shaft 14 in an axial direction and second end 26 which branches in the radial direction at a point at second end 18 of motor shaft 14 so as to define exit ports 28 exiting in a generally radial direction. Thus, as can be seen, fluid can enter first end 24 of motor shaft passageway 22, flow to second end 26 of motor shaft passageway 22 and exit through exit ports 28 in a generally radial direction.

Motor 12 can be any type of motor. For example, conventional electric, hydraulic, or pneumatic motors can be used. In the preferred embodiment, a hydraulic motor of the type Parker Model No. M2C-085 is used with modified motor shaft 14. Motor 12 in its general form comprises a motor housing 30 with hydraulic fluid inlet port 32. The type of motor used in the present invention is not critical, and it is actually an objective of the present invention to be able to use any of a variety of off-the-shelf motors in conjunction with modified motor shaft 14 of the present invention.

Assembly 10 also comprises swivel 38 that includes swivel shaft 40 rotatably received in swivel housing 42. Swivel 38 can be any of a variety of commercially available swivels, for example, the Hammelmann 00.00062.0086 and Flow Model No. 2410. In the context of the present invention, swivel shaft 40 has shaft end 44 coupled to first end 16 of motor shaft 14 such that swivel shaft 40 and motor shaft 14 are in axial alignment. Swivel shaft 40 also defines swivel passageway 46 which exits swivel shaft 40 in the axial direction in communication with motor shaft passageway 22. Swivel shaft 40 and motor shaft 14 are coupled such that they rotate together while allowing fluid flow to pass from swivel passageway 46 to motor shaft passageway 22.

Swivel shaft 40 also has a supply end rotatably received in swivel housing 42. Swivel housing 42 comprises supply passageway 50 which communicates fluid flow to swivel passageway 46 while swivel shaft 40 rotates relative to swivel housing 42 as is commonly known in the swivel art.

Swivel shaft 40 and motor shaft 14 are connected at a point outside of motor housing 30 to allow for ease of making and breaking the connection between swivel shaft 40 and motor shaft 14. A variety of constructions can be used to couple swivel shaft 40 in axial alignment with motor shaft 14. The preferred embodiment as shown in FIG. 1 comprises aligning nut 58 which has first socket 60 for receiving first end 16 of motor shaft 14 and second socket 62 for receiving shaft end 44 of swivel shaft 40. First and second sockets 60, 62 are formed in axial alignment to insure axial alignment of motor shaft 14 with swivel shaft 40 when they are placed in the first and second sockets, respectively. In order to counter the separation force between swivel shaft 40 and motor shaft 14 when fluid is flowing from one to the other, split rings 64 and 66 are provided at first end 16 and shaft end 44, respectively, to provide radially extending surfaces to be engaged by flanges 70 and 72, respectively. Bolts 74 connect flanges 70 and 72 together to positively clasp first end 16 relative to shaft end 44. Flanges 70 and 72 have a hole with a diameter larger than their respective shaft but yet smaller than the radial extent of their respective split ring such that the flange will engage the split ring. In the preferred embodiment, button 76 is placed between shaft end 44 and first end 16 and becomes compressed therebetween upon tightening of bolts 74. Compression of button 76 effects a seal to prevent escape of fluid from between shaft end 44 and first end 16. Button 76 is preferably bronze and has hole 80 therethrough to allow passage of the fluid flowing from swivel shaft 40 to motor shaft 14.

Having first end 16 of motor shaft 14 extend outside of motor housing 30 allows for the use of the simple flange to flange connection just described. If there is any leakage between shaft end 44 and first end 16, such can be readily observed. Similarly, if a swivel fails or if a different type is needed, the new swivel can be readily replaced into the assembly by simply being coupled to the exposed first: end 16 of motor shaft 14. The external dimensions and configuration of modified motor shaft 14 is readily adaptable to fit a variety of motors. No alterations need be made to a motor housing to accommodate the coupling of swivel assembly 38 to first end 16 of modified motor shaft 14.

Nozzle assembly 90 is mounted to second end 18 of motor shaft 14. Nozzle assembly 90 comprises hub 92 mounted over second end 18 of motor shaft 14. Hub 92 has radial passageways 94 in communication with exit ports 28. Spray arms 96 are mounted to hub 92 and define a spray passageway in communication with radial passageways 94. Spray arms 96 have proximal ends 98 connected to hub 92 and distal ends 100 defining nozzles 102. Hub 92 is fixed to second end 18 of motor-shaft 14 such that it rotates with motor shaft 14.

In the preferred embodiment, it is desired to have a sealing mechanism between hub 92 as it rotates relative to motor housing 30 to prevent fluid from entering the motor housing between the motor housing and motor shaft 14 as motor shaft 14 is rotating. Accordingly, hub 92 has surface 104 facing surface 108 on motor housing 30. Between surfaces 104 and 108 is teflon bushing 110. Additionally, seal race 112 is disposed against surface 108 to provide a sealing surface for V-seal 114 which seals between race 112 and surface 104.

In operation, a fluid, typically water, is supplied under pressure to supply passageway 50. The fluid flows through swivel passageway 46, through motor shaft passageway 22, through radial passages 94, through spray arms 96 and finally exits nozzles 102. Swivel shaft 40, motor shaft 14, hub 92 and spray arms 96 all rotate together. Swivel shaft 40 rotates within swivel housing 42 as is known and motor shaft 14 rotates within motor 12 as is known.

To uncouple swivel 38 from motor 12, bolts 74 are turned to unattach flanges 70 and 72, swivel shaft 40 is pulled away from aligning nut 58 and out of second socket 62, flange 72 is pushed toward swivel housing 42 to clear split ring 66, the two halves of split ring 66 are removed from swivel shaft 40, and flange 72 can now be slid off of swivel shaft 40.

To couple a new swivel 38 to motor shaft 14, flange 72 is slid onto swivel shaft 40 beyond circumferential groove 67, the two halves of split ring 66 are placed in circumferential groove 67, flange 72 is slid down to engage split ring 66, shaft end 44 of swivel shaft 40 is placed in second socket 62 of aligning nut 58, and bolts 72 are threaded into first flange 70.

It should be understood that second end 26 of motor shaft passageway 22 can be configured in a variety of ways. For example, FIGS. 2 and 3 illustrate an alternative embodiment where second end 26 of motor shaft passageway 22 exits second end 18 of motor shaft 14 in an axial direction instead of a radial direction.

Figure 2:
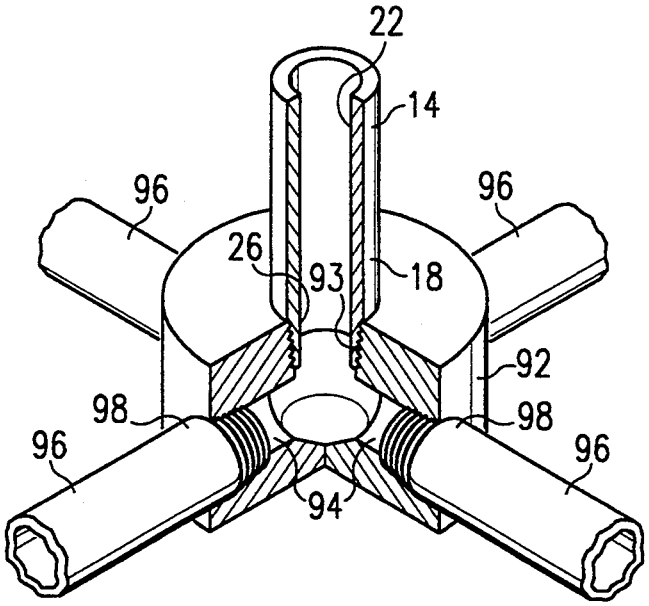
FIG. 2 is a cut-away perspective of an alternative embodiment of the nozzle to motor shaft connection.

Furthermore, FIG. 2 illustrates an alternative nozzle to motor shaft connection. Hub 92 is threaded onto second end 18 at threads 93 such that motor shaft passageway 22 communicates with passages 94 in hub 92. Four spray arms 96 are shown threaded into hub 92. It should be understood that any nozzle configuration may be used.

Figure 3:
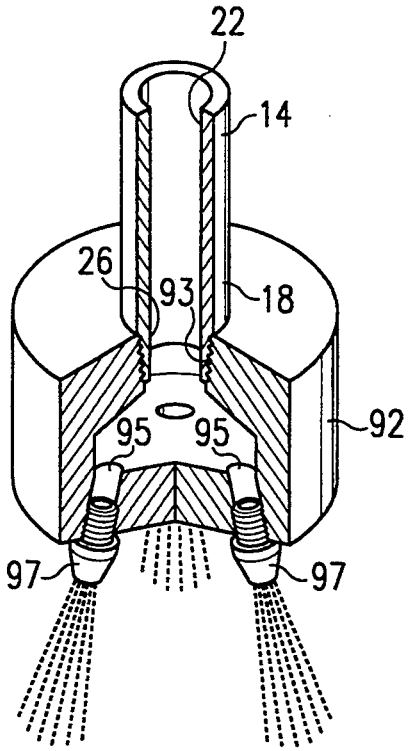
FIG. 3 is a cut-away perspective of another alternative embodiment of the nozzle to motor shaft connection.

In FIG. 3, nozzles 97 are directly threaded into the bottom of hub 92 and are in communication with motor shaft passageway 22 by ports 95 in hub 92 which is threaded to second end 18 by threads 93. Nozzles can be communicated to motor shaft passageway 22 by being directly attached to motor shaft 14 instead of being indirectly attached by spray arms or other attachments as in FIGS. 1–3.

Although a single embodiment of the invention has been illustrated in the accompanying drawing and described in the foregoing Detailed Description, it will be understood that the invention is not limited to the embodiment disclosed, but is capable of numerous rearrangements, modifications and substitutions of parts and elements without departing from the spirit of the invention as embodied in the following claims.

We claim:

1. A direct drive motor and swivel assembly for transmission of fluid, comprising:

(a) a motor;

(b) a motor shaft extending through and rotationally driven by the motor, the motor shaft having a first end and a second end opposite thereto, at least the first end of the motor shaft disposed outside of the motor, the motor shaft defining a shaft passageway extending therethrough from the first end to the second end;

(c) a swivel comprising a swivel housing and a swivel shaft having a supply end rotationally retained in the swivel housing and a shaft end opposite thereto outside of the swivel housing, the swivel shaft defining a swivel passageway extending therethrough from the supply end to the shaft end, the swivel shaft being axially aligned with the motor shaft and the shaft end of the swivel shaft being coupled to the first end of the motor shaft at a point outside the motor and such that the swivel passageway is in communication with the motor shaft passageway, the swivel housing defining a supply passageway for receiving the fluid and communicating the fluid to the swivel passageway.

2. The assembly of claim 1 further comprising a spray arm having a proximal end and a distal end, the spray arm defining a spray passageway extending therethrough from the proximal end to the distal end, the proximal end attached to the second end of the motor shaft such that the shaft passageway is in communication with the spray passageway and such that the spray arm rotates with the motor shaft.

3. The assembly of claim 1 wherein the second end of the motor shaft is disposed outside of the motor and the motor shaft passageway branches at least one point at the second end of the shaft so as to define a plurality of generally radial exit ports at the second end of the shaft.

4. The assembly of claim 3 further comprising a plurality of nozzles affixed to the second end of the motor shaft such that each nozzle is aligned with at least one of the plurality of exit ports.

5. The assembly of claim 4 further comprising an annular hub defining at least one radial passage therethrough, the hub mounted on the second end of the motor shaft such that the radial passage is in communication between at least one of the plurality of exit ports and one of the nozzles.

6. The assembly of claim 3 wherein at least two of the plurality of exit ports are at the same axial position on the motor shaft.

7. The assembly of claim 1 further comprising an aligning nut having a first socket receiving the first end of the motor shaft and a second socket receiving the shaft end of the swivel shaft in axial alignment with the motor shaft.

8. The assembly of claim 7 further comprising a motor shaft flange extending radially from the first end of the motor shaft and, a swivel flange extending radially from the shaft end of the swivel shaft, the motor shaft flange and the swivel shaft flange releasably connected to each other such that the swivel can be readily coupled to and uncoupled from the motor shaft.

9. The assembly of claim 1 wherein the motor is a hydraulic motor.

10. A direct drive motor and swivel assembly for transmission of fluid, comprising:

(a) a motor;

(b) a motor shaft extending through and rotationally driven by the motor, the motor shaft having a first end and a second end opposite thereto, at least the first end of the motor shaft disposed outside of the motor, the motor shaft defining a shaft passageway extending therethrough from the first end to the second end;

(c) a swivel comprising a swivel housing and a swivel shaft having a supply end rotationally retained in the swivel housing and a shaft end opposite thereto outside of the swivel housing, the swivel shaft defining a swivel passageway extending therethrough from the supply end to the shaft end, the swivel shaft being axially aligned with the motor shaft and the shaft end of the swivel shaft being coupled to the first end of the motor shaft at a point outside the motor to align the swivel passageway in communication with the motor shaft passageway, the swivel housing defining a supply passageway for receiving the fluid and communicating the fluid to the swivel passageway;

(d) a spray arm having a proximal end and a distal end, the spray arm defining a spray passageway extending therethrough from the proximal end to the distal end, the proximal end attached to the second end of the motor shaft to align the shaft passageway in communication with the spray passageway;

(e) an aligning nut having a first socket receiving the first end of the motor shaft and a second socket receiving the shaft end of the swivel shaft in axial alignment with the motor shaft; and (f) a motor shaft flange extending radially from the first end of the motor shaft and a swivel flange extending radially from the shaft end of the swivel shaft, the motor shaft flange and the swivel shaft flange releasably connected to each other such that the swivel can be readily coupled to and uncoupled from the motor shaft.

11. A method for directly driving a swivel for transmission of fluid, the swivel having a swivel shaft defining a swivel passageway, the method comprising the steps of:

(a) installing a modified motor shaft in a motor, the motor shaft having a first end and a second end opposite thereto, at least the first end of the motor shaft is disposed outside of the motor, the motor shaft defining a shaft passageway extending therethrough from the first end to the second end;

(b) coupling the swivel shaft of the swivel in axial alignment with the first end of the motor shaft such that the swivel passageway through the swivel shaft is in communication with the motor shaft passageway; and (c) mounting at least one nozzle to the second end of the motor shaft such that the nozzle is in communication with the motor shaft passageway.

* * * * *